United States Patent [19]

Brautovich

[11] Patent Number: 5,039,148

[45] Date of Patent: Aug. 13, 1991

[54] DISPOSABLE, FOLDABLE SCOOP FOR DOG WASTE

[76] Inventor: John J. Brautovich, 1009 Lombard St., San Francisco, Calif. 94109

[21] Appl. No.: 386,349

[22] Filed: Jul. 28, 1989

[51] Int. Cl.[5] ..... A01K 29/00

[52] U.S. Cl. ..... 294/1.3; 294/55

[58] Field of Search ..... 294/1.3, 55; 15/257.1, 15/257.9, 104.8; 229/117.01

[56] References Cited

U.S. PATENT DOCUMENTS

| | | | |
|---|---|---|---|
| 3,286,826 | 11/1966 | Stoll | 206/47 |
| 3,885,266 | 5/1975 | Nafziger | 15/257.1 |
| 3,971,503 | 7/1976 | Allan et al. | 229/38 |
| 4,103,952 | 8/1978 | Thompson | 294/1 R |
| 4,155,581 | 5/1979 | Kanaga | 294/55 |
| 4,186,955 | 2/1980 | Campbell | 294/1 R |
| 4,205,869 | 6/1980 | Mathis | 294/1 B |
| 4,251,097 | 2/1981 | Whitten, II | 294/1 B |
| 4,252,356 | 2/1981 | Tokuzumi | 294/1 B |
| 4,272,116 | 6/1981 | Tufte | 294/1 B |
| 4,431,222 | 2/1984 | Rotella | 294/1 B |
| 4,458,932 | 7/1984 | Resch | 294/1 B |
| 4,715,495 | 12/1987 | Henry | 294/1.3 X |
| 4,830,419 | 5/1989 | Watanabe | 294/1.3 |

FOREIGN PATENT DOCUMENTS

| | | | |
|---|---|---|---|
| 2612164 | 10/1977 | Fed. Rep. of Germany | 294/1.3 |
| 2556560 | 6/1985 | France | 294/1.3 |

*Primary Examiner*—Margaret A. Focarino
*Assistant Examiner*—Dean J. Kramer
*Attorney, Agent, or Firm*—Thomas M. Freiburger

[57] ABSTRACT

A device for conveniently picking up dog waste from streets, sidewalks, grass, etc. is very flat in an initial folded configuration, for example less than one-eighth inch in folded thickness, so that it is easily stored in a pocket or purse. Preferably formed of folded paper lined in some areas with foil, the device is folded generally in a Z shape, with a cardboard stiffener on a bottom panel. The folded device is easily pulled open to a scoop-like configuration, and a loose piece of cardboard is exposed when the scoop is opened. The piece of cardboard is used as a paddle with one hand to push the waste material into the scoop. Once this is completed, the loose cardboard piece is put back in the scoop and a top panel of the Z-shaped device is swung around to a position of closing the scoop defined by the other two panels. Side flaps are then moved over the top panel to further seal the closure, and a rubber band secured to the device is removed and used to retain the closed configuration.

3 Claims, 2 Drawing Sheets

DISPOSABLE, FOLDABLE SCOOP FOR DOG WASTE

BACKGROUND OF THE INVENTION

The invention relates to animal waste pickup and disposal apparatus, and in particular the invention is concerned with a disposable device for easily picking up animal waste such as dog excrement or other debris and for being conveniently dispensed from a very flat initial configuration.

Most municipalities have laws that relate to the clean-up and disposal of pet litter. For example, the City of San Francisco's Health Code under Article 40 states:

> "It shall be unlawful for an owner or custodian of any dog who permits said dog to defecate on public or private property or who walks a dog without carrying a container suitable for the removal and disposal of excrement."

A great number of prior devices have been disclosed for use in picking up wastes dropped by animals or other unsanitary materials. For example, see U.S. Pat. Nos. 3,286,826; 3,885,266; 3,971,503; 4,103,952; 4,155,581; 4,186,955; 4,205,869; 4,251,097; 4,252,356; 4,272,116; 4,431,222; and 4,458,932.

Unfortunately, the devices previously available for such purposes are not used or accepted by pet owners for some or all of the following reasons:

1. Too costly.
2. Require assembly prior to use.
3. Depend on functioning or meshing components to be effective.
4. Leave waste on exposed outside of container if carelessly used.
5. Are awkward or too bulky to carry in pocket or purse.
6. Cannot be used on difficult or varying terrain.
7. Are not 100% disposable.
8. Do not accommodate various stool consistencies or sizes.
9. Are unsightly and objectionable when full.
10. Cannot be made reasonably odor and leak-proof.

Several of the prior patents have made some provision for mess-free handling of the animal wastes and sanitary packaging of the picked up material. U.S. Pat. Nos. 3,885,266; 4,155,581 and 4,186,955 show apparatus intended toward these purposes. These patents also disclose devices intended for disposable use and formed, at least in part, of paper.

However, the devices of these patents have either been of low storage capacity, cumbersome or time consuming in use (for example requiring several folding or unfolding or assembly steps prior to use), poorly sealed against escape of vapors after use, or requiring an additional component such as a bag or box for receiving a first container.

While a number of the objects of the present invention have been addressed in different ways by various examples of prior waste pickup and disposal devices, none of the prior devices has included features providing the compact, flat storage, easy dispensing, convenience and speed of use, compactness in wrapped configuration and integrity of containment as in the present invention described below.

SUMMARY OF THE INVENTION

In accordance with the present invention, a disposable animal waste pickup and disposal device, particularly for dogs, is made primarily of paper and has a number of features which make it superior in many ways to any of the previously disclosed waste pickup devices. No assembly is required, and minimal manipulation is needed.

The device, which enables convenient pickup of dog waste or other materials from streets, sidewalks, grass, etc. is very flat in an initial folded configuration. For example, it may be less than one-eighth inch in folded thickness (preferably 1/16 inch to 3/32 inch), so that it is easily stored in a pocket or purse or packed in a bound stack for purchase.

Preferably formed of folded paper lined in some areas with foil, the device is folded generally in a Z shape, with a cardboard stiffener on a bottom panel in a preferred embodiment.

The folded device is easily pulled open to a scoop-like configuration, and a loose piece of cardboard is exposed and available when the scoop is opened. The piece of cardboard is used as a paddle with one hand to push the waste material into the scoop. Once this is completed, the loose cardboard piece is put back in the scoop and a top panel of the Z-shaped device is swung around to a reversed position of wrapping around and closing the scoop defined by the other two panels. Side flaps are then moved over the top panel to further seal the closure, and a rubber band secured to the device is removed and used to retain the closed configuration.

An advantage of this invention is that it can be manufactured from any inexpensive, waterproofed paper of sufficient gauge to contain the contents with reliability. The paper must possess enough dead-fold character to remain in place when manipulated. Also, the paper must be essentially waterproof.

It is therefore among the objects of the invention to improve over previous animal waste pickup and disposal apparatus by providing a disposable device which is very inexpensively manufactured, which is flat and compact enough to fit in a pocket before use, which is quickly, conveniently and sanitarily used to pick up animal excrement, and which completely encloses and wraps the excrement after pickup, substantially sealing in odors. These and other objects, advantages and features of the invention will be apparent from the following description of a preferred embodiment, considered along with the accompanying drawings.

DESCRIPTION OF THE DRAWINGS

FIGS. 1 through 9 illustrate the series of folds performed on a sheet of flexible material in the device of the invention.

DESCRIPTION OF PREFERRED EMBODIMENTS

Figure 1:
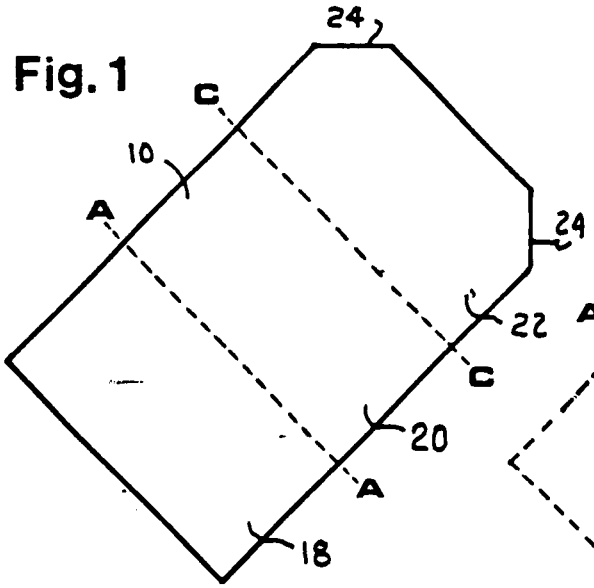
FIGS. 1 through 9 show a series of steps in producing a compactly folded animal waste pickup and storage device in accordance with the method and apparatus of the present invention.
Figure 7:
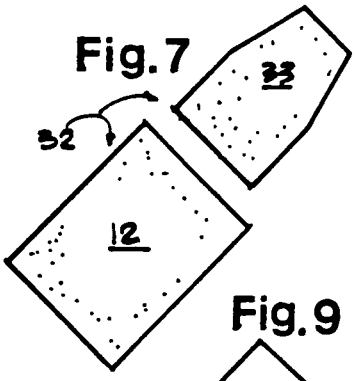
Figure 8:
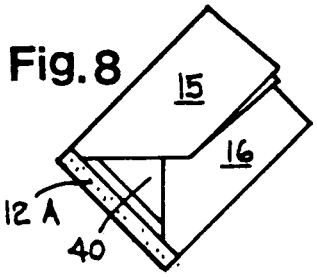
Figure 9:
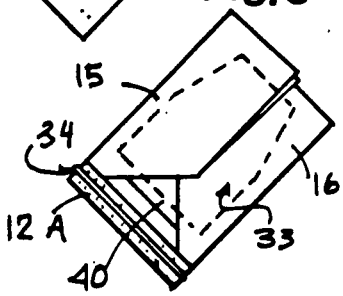

In the drawings, FIG. 1 shows a sheet of material 10 which is taken through a relatively simple series of folds illustrated in FIGS. 2 through 9, and with the addition of a stiffer sheet of material 12 shown in FIG. 7, to become a flatly and compactly folded waste pickup device 14 as illustrated in FIG. 9.

The sheet of material 10 preferably has a "dead fold" characteristic, which assures that the folds made during the steps of FIGS. 1–9 will remain and will not tend to spring back open to any significant degree. To this end, the sheet of material 10 may comprise of Kraft paper of medium bag weight (e.g. 30 lb. Kraft) laminated to a thin sheet of foil. This is the preferred embodiment. This foil side will become the inside surfaces of a scoop. The sheet 10 can be made of many different materials. The essential features are that the sheet is waterproof and has good dead-fold characteristics. In FIG. 1, the foil side of the sheet 10 is down, opposite the surface illustrated.

As can be seen from the series of steps illustrated in FIGS. 1 through 9, the sheet of material 10 is folded generally into a Z-shaped configuration, although the finished folded product 14 is somewhat more complicated than a simple Z shape. The fully folded and assembled product 14 has a pair of left and right flaps 15 and 16 which help to form a scoop-like configuration in use and which help envelop the waste material picked up in the scoop.

Figure 2:
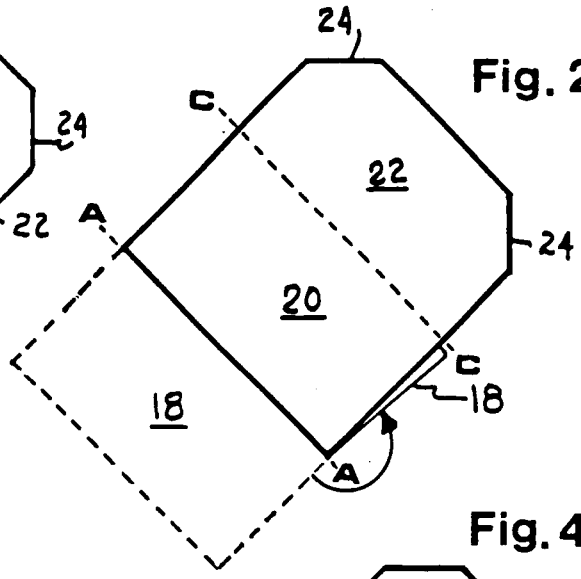

As illustrated in FIGS. 1 and 2, the sheet of material 10 is divided by fold lines A and C into three sections or panels 18, 20 and 22. Panels 18 and 20 preferably are equal in length. Panel 22 is one-half inch shorter. Panel 18 is folded under the center panel 20 to become a lower or bottom panel as shown in FIG. 2. The panel or section 22 ultimately becomes an upper panel which will eventually be used to wrap around the other two panels when they contain the waste material between them. As shown in the drawing figures, this top panel 22 preferably has beveled, cut-off corners 24 in the preferred embodiment illustrated.

Figure 3:
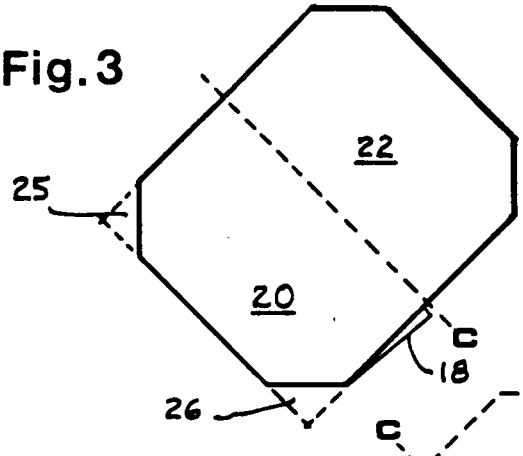
Figure 4:
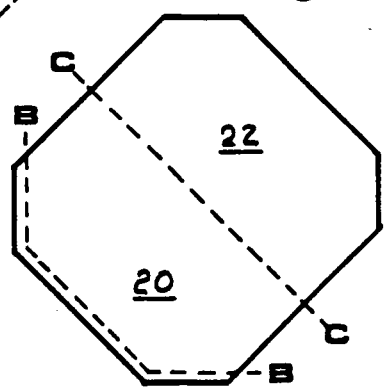

As shown in FIGS. 3 and 4, corners 25 and 26 adjacent to the fold line A are cut off, with the cut edge sealed by heat that activates a heat-sensitive adhesive along axis B—B. This is the preferred embodiment of the invention. Alternatively, the corners could be folded flatly against the center panel 20 and then be stapled or glued in this configuration.

Whichever method is used, the essential purpose is to create a water-tight seal along axis B—B. This axis forms the base of the future scoop or pocket. A further purpose is to provide the bevel cuts that match bevel cuts 24 in panel 22. This is necessary to provide ease in operation of the folded device 14, as explained below with reference to other figures.

Figure 5:
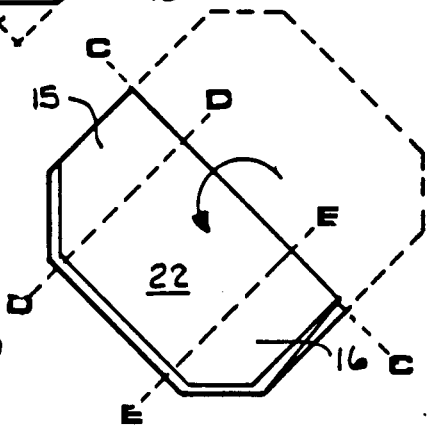

FIG. 5 shows the next step in the folding of the sheet of material 10. The top panel or section 22 is folded along the fold line C, down against the center panel 20 as indicated. This completes the Z-shaped configuration.

Figure 6:
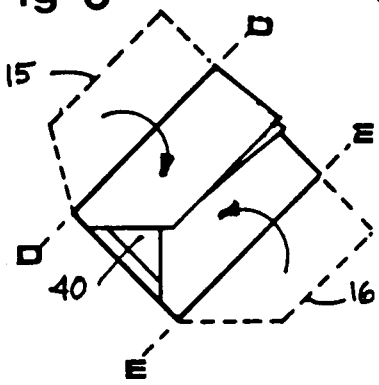

Next, as shown in FIGS. 5 and 6, in this preferred embodiment side flaps 15 and 16 are folded inward, along fold lines D and E indicated in FIG. 5. FIG. 6 shows the waste pickup device with these side flaps 15 and 16 folded down flatly, preferably overlapping somewhat as illustrated and narrowing the width of the folded waste pickup device to less than half its width as shown in the previous figures.

FIG. 7 shows pieces of relatively rigid material 12 and 33, stiffer than the flexible sheet of material from which the device is folded. These pieces of material 12 and 33 may be, for example, cardboard of about 1/32 inch thickness, or other material suitable to make the bottom panel or section 18 of the device rigid and also sufficient to serve as a paddle or pusher to force waste material from the ground into the device 14 when it is held in a scoop-like configuration. As indicated in FIG. 7, the pieces 12 and 33 may be cut from an initial single sheet 32.

The stiff piece of material is cut to the configurations shown in FIG. 7, to form the stiffener 12 and a pusher or paddle 33. As shown in FIG. 8, the stiffener 12 is secured to the bottom surface of the folded sheet, preferably on the bottom, outside surface of the bottom panel 18, although in an alternative embodiment the stiffener 12 can be fastened on the upper or inside surface of the panel 18.

The stiffener 12, in the preferred embodiment illustrated, has a width substantially the same as the bottom outside surface of the panel 18, and a length which is slightly longer than that of the panel 18, e.g. 3/16 inch longer. It may be secured to the bottom panel 18 by stapling and/or adhesive. A tail portion 12*a* extends outwardly from the folded device as illustrated in FIGS. 8 and 9. This provides a location for attachment of a stretched, tensioned rubber band 34 as shown in FIG. 9. As explained further below, the rubber band 34 is used to retain the device in a closed, wrapped position after waste material has been picked up.

The relatively stiff paddle or pusher 33 is placed inside the folded device, between the bottom panel 18 and the center panel 20. It is preferably trimmed at side edges 36 so as to be somewhat narrower in width than the stiffener 12 and the bottom and center panels 18 and 20. It is thus more easily received inside the folded device 14.

FIG. 9 shows the preferred embodiment of the folded waste pickup device 14, in a flat, very thin configuration for packaging and ready for use.

Figure 10:
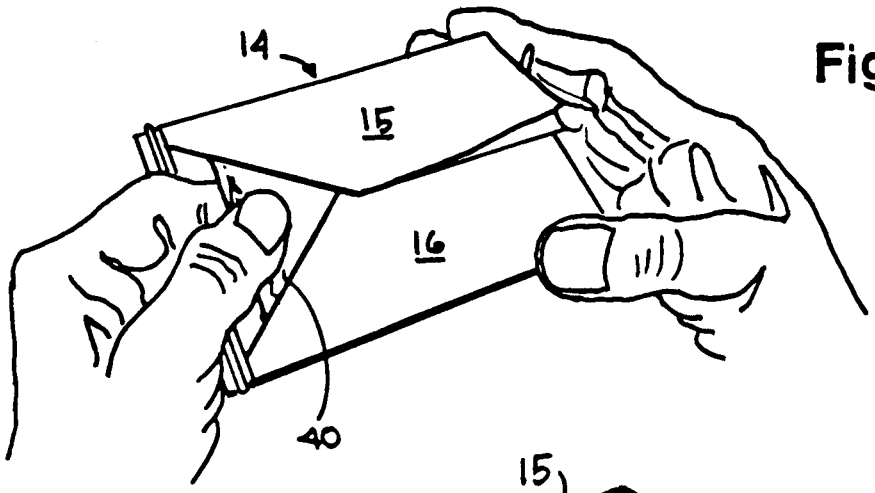
FIG. 10 is a prospective view showing the manner in which a user of the device holds the device and pulls on an end of the sheet of material to open the device into a scoop.
Figure 11:
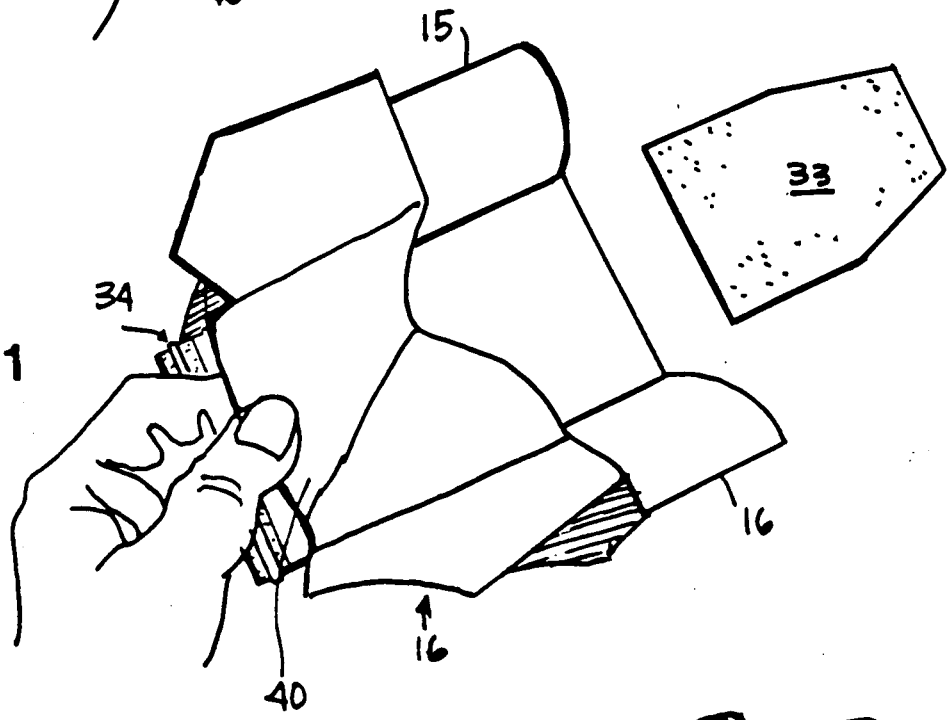
FIG. 11 is a prospective view showing the opened waste pickup device in a scoop-like configuration, held in one hand and with a separate flat paddle or pusher section of material removed from the scoop and available for use in the other hand to push waste materials into the scoop-like opening.
Figure 12:
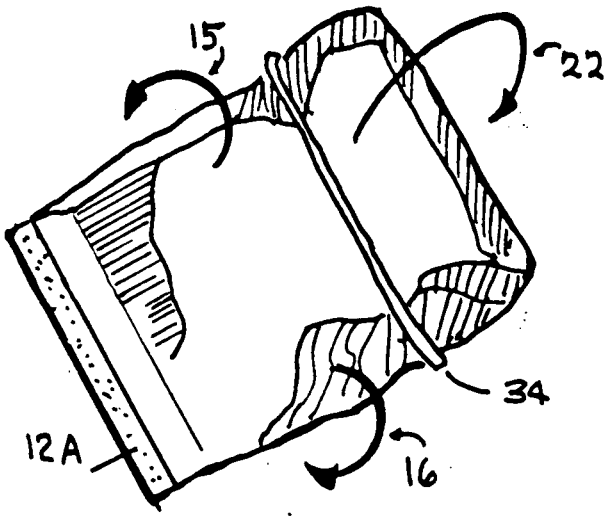
FIG. 12 is another prospective view showing the device as closed and wrapped and retained in the closed position with a rubber band, with an upper flap having been brought around to a reversed position to enclose the package.

FIGS. 10 through 12 demonstrate the use of the waste pickup and storage device 14 in accordance with the invention. In FIG. 10 the folded device 14 is shown held by a user, whose left hand grips the upper, free end 40 (see also FIGS. 6, 8 and 9) of the upper panel 22, between the thumb and forefinger as indicated. When this edge 40 is pulled, the middle and lower panels 20 and 18 will separate somewhat, and the side flaps 15 and 16 will spring mostly open, forming the device into a scoop-like configuration as shown generally in FIG. 11. The upper panel 22 is of course connected to the upper end of the middle panel 20, so that this tension pulls the middle panel pivotally away from the lower panel 18. However, the separation of the lower panel 18 and middle panel 20 is limited because of the seal along axis B—B, i.e. the bound beveled corners 25 and 26 indicated in FIG. 3. The scoop-like shape is formed between the lower and middle panels, the side flaps (which comprise two opened layers of material) and the bound beveled corner areas.

As FIG. 11 illustrates, once the panel end 40 has been pulled to open the device into the scoop-like configuration, the panel end 40 may then be held in this position with one hand. The pusher or paddle 33 may then be removed from the scoop-like opening with the other hand, and the device is then conveniently used to push or sweep waste debris into the scoop-like opening, without risk of dirtying the hands. The pusher 33 is placed back in the opening with the waste.

Once the waste is contained in the scoop-like opening of the device, the top panel 22 is then lifted and brought around to the back of the device to overlap the bottom panel 18 and the stiffener 12, in a reverse fold from its original configuration. Then the side flaps 15 and 16 are folded inward. This is shown in FIG. 12, although the side flaps are hidden from view in FIG. 12. The rubber band is removed from the stiffener extension 12*a* at a handle area 42 (formed of the stiffener 12 and the end of folded layers 18 and 20). The rubber band 34 is stretched and slipped over the closed package 14*a*, which is then ready for disposal.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A disposable device for picking up and wrapping waste material, comprising, a sheet of flexible material folded generally into a Z-shape with lower, middle and upper panels and with a pair of side flaps formed by folding of left and right side portions of the Z-shaped folded sheet toward themselves over one of the panels, the device being very flat and thin as folded, the lower and middle panels with the side flaps having means forming a scoop when the folded device is partially opened, and an unattached piece of flat, relatively stiff material being contained in the scoop so as to be available when the device is opened, to serve as a pusher or paddle for pushing waste material into the opened scoop, stiffener means comprising a cardboard stiffener secured to the lower panel for reinforcing the lower panel when it is placed against the ground or other surface to gather waste material into the scoop, the top panel being foldable in an opposite direction from its position in the Z configuration so that it may be swung around and wrapped over the other two panels with waste material contained between said other two panels, after which the side flaps may be folded toward each other and over the top panel, retaining means comprising a rubber band for holding the device in the wrapped, closed position to contain the picked-up waste securely inside, and wherein the rubber band is stored in stretched configuration on the device when the device is in the flat, Z-shaped configuration.

2. A disposable device for picking up and wrapping waste material, comprising, a sheet of flexible material folded generally into a Z-shape with lower, middle and upper panels and with a pair of side flaps formed by folding of left and right side portions of the Z-shaped folded sheet toward themselves over one of the panels, the device being very flat and thin as folded, the lower and middle panels with the side flaps having means forming a scoop when the folded device is partially opened, and an unattached piece of flat, relatively stiff material being contained in the scoop so as to be available when the device is opened, to serve as a pusher or paddle for pushing waster material into the opened scoop, stiffener means on the lower panel for reinforcing the lower panel when it is placed against the ground or other surface to gather waste material into the scoop, the top panel being foldable in an opposite direction from its position in the Z configuration so that it may be swung around and wrapped over the other two panels with waste material contained between said other two panels, after which the side flaps may be folded toward each other and over the top panel, and retaining means for holding the device in the wrapped, closed position to contain the picked-up waste securely inside, and wherein the side flaps each have a triangular cut-out area at an end opposite the end where the scoop opens, exposing an upper edge of the upper panel for gripping by a user when the device is in folded configuration, whereby said upper edge may be gripped between the thumb and forefinger and pulled relative to the stiffener means to quickly open the scoop by swinging the middle panel upward and open with respect to the lower panel.

3. A disposable device for picking up and wrapping waste material, comprising, a sheet of flexible material folded generally into a Z-shape with lower, middle and upper panels and with a pair of side flaps formed by folding of left and right side portions of the Z-shaped folded sheet toward themselves over one of the panels, the device being very flat and thin as folded, the sheet of flexible material comprising paper laminated to foil on one side, forming a dead-fold characteristic whereby folds in the flexible material tend to remain folded, and whereby the paper is made substantially waterproof, the lower and middle panels with the side flaps having means forming a scoop when the folded device is partially opened, and an unattached piece of flat, relatively stiff material being contained in the scoop so as to be available when the device is opened, to serve as a pusher or paddle for pushing waste material into the opened scoop, stiffener means on the lower panel for reinforcing the lower panel when it is placed against the ground or other surface to gather waste material into the scoop, the top panel being foldable in an opposite direction from its position in the Z configuration so that it may be swung around and wrapped over the other two panels with waste material contained between said other two panels, after which the side flaps may be folded toward each other and over the top panel, and retaining means for holding the device in the wrapped, closed position to contain the picked-up waste securely inside.

* * * * *